United States Patent [19]

Lee

[11] 4,370,063

[45] Jan. 25, 1983

[54] CLOCK WITH DUAL TIME-INDICATORS

[76] Inventor: Joseph Lee, 43 S. Russell St., Boston, Mass. 02114

[21] Appl. No.: 226,422

[22] Filed: Jan. 19, 1981

[51] Int. Cl.[3] ..... G04B 25/00; G04B 19/00

[52] U.S. Cl. ..... 368/71; 368/76

[58] Field of Search ..... 368/10, 3, 62, 76–78, 368/80, 220–222, 223, 228, 232–235, 276, 284, 294, 316–317, 71

[56] References Cited

U.S. PATENT DOCUMENTS

| | | | |
|---|---|---|---|
| Re. 22,640 | 5/1945 | Prins | 368/77 |
| 239,738 | 4/1881 | Dee | 368/228 |
| 1,850,184 | 3/1932 | Spainhower | 368/223 |
| 2,340,442 | 2/1944 | Toce et al. | 368/91 |
| 2,734,338 | 2/1956 | Uhlig et al. | 368/78 |

FOREIGN PATENT DOCUMENTS

| | | | |
|---|---|---|---|
| 784380 | 7/1935 | France | 368/223 |

*Primary Examiner*—Vit W. Miska

*Attorney, Agent, or Firm*—Thompson, Birch, Gauthier & Samuels

[57] ABSTRACT

A clock with dual time-indicators, one of each of the indicators being located at a transparent face at opposite ends of a clock casing, includes a drum which is mounted within the casing and is driven by a motor at a rate of one revolution per each twelve hour period or multiple thereof. One time indicator is provided by dial markings on one of the transparent faces, an hour hand marked on one end of the drum, and a minute hand disposed between the dial markings and hour hand. The other time-indicator is provided by dial markings at the other end of the drum and a line marker on the other transparent face.

10 Claims, 3 Drawing Figures

CLOCK WITH DUAL TIME-INDICATORS

BACKGROUND OF THE INVENTION

1. Field of the Invention

The present invention relates to time-indicating devices and, more particularly, is directed toward a dual time-indicating device.

2. Description of the Prior Art

A variety of clock configurations have been designed with single movements and multiple faces. For example, U.S. Pat. No. 3,106,817 discloses a clock with three dials that are operated from a single drive mechanism. Generally, multiple dial clocks have suffered from the disadvantage that they have relatively complex drive systems. A need exists for an improved single movement clock mechanism which provides dual time-indicating faces without the need for a complex gear arrangement. A need also exists for a clock mechanism that shows time going forward on a front face and going backward on a rear face.

SUMMARY OF THE INVENTION

It is an object of the invention to provide a dual time-indicating clock which does not suffer from the heretofore mentioned disadvantages.

Another object of the invention is to provide a clock that shows time moving forward and moving backward on opposite ends of a single rotating drum. Such a drum is mounted within the casing of the clock and is driven by a motor at a rate of one revolution per each twelve-hour period or multiple thereof. A first drumhead, at one end of the rotating drum, has a central circular hole cut out of it, and bears the hourly dial-markings of a clock face along its periphery, as it revolves. This face is enclosed beneath a protective, stationary, and transparent surface of glass or plastic, which bears no marking, except for a single, stationary pointer decaled on its under surface at its top edge or "zenith" point. The revolving drum so enclosed, at this end of the clock, appears to rotate with a counter-clockwise motion. A second drumhead at the opposite end of the revolving drum rotates clockwise, and has no marking on it, except for a single hour-hand painted upon it. At this end of the clock-casing, an outer, protective, stationary and transparent surface of glass or plastic is distinguished by hourly dial-markings, similar to a conventional clock, decaled upon its under face, along the very edge of its stationary periphery. Between this outer, transparent, fixed surface at this end, and the second revolving drumhead enclosed beneath there revolves in mid-space a conventional minute-hand conventionally attached to the inner, concentric drive-shaft of the clock's motor. Except for minute-hand, the mechanism is driven by the outer, concentric single drive-shaft of a single motor, as it attaches to the center of the second drumhead at this end. The clock serves its new purpose of showing time apparently marching forward or clockwise at this conventional clockwise end of the clock, and showing time apparently moving backward or counter-clockwise (from the future back into the past) at the opposite end.

A further object of the invention is to provide a clock with dual time-indicators, one of which is located at one end of a clock casing and the other of which is located at an opposite end of the clock casing. A rotatable drum is mounted within the casing and is driven by a motor at a rate of one revolution per each twelve hour period or multiple thereof. The casing has transparent faces at opposite ends thereof, one of the faces having dial markings and the other face having a line marker. One end of the drum is provided with a painted or decaled hour hand and the other end is provided with dial markings. The transparent face with the dial marking and the drum end with the hour hand marking are mounted in juxtaposition and constitute one time-indicator. A minute hand, which is mounted to a shaft of the motor, is disposed between the dial markings and hour hand marking. The transparent face with the line marker and the drum end with the dial markings are mounted in juxtaposition and define the other time-indicator. The same time is presented at the clock ends. In an alternative configuration, the time at different time zones is presented at the clock ends.

Other objects of the present invention will in part be obvious and will in part appear hereinafter.

The invention accordingly comprises the apparatuses and products, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DESCRIPTION OF THE PREFERRED EMBODIMENTS

Figure 1:
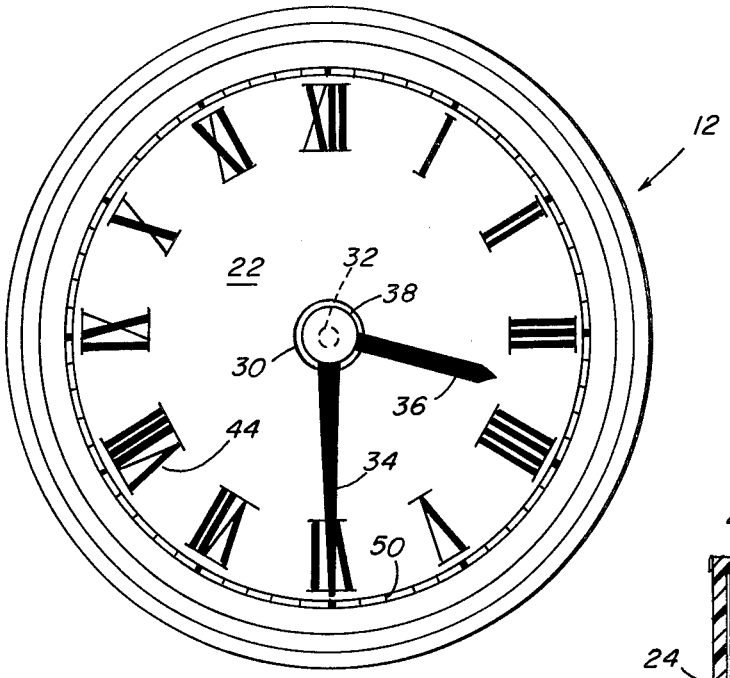
FIG. 1 is a plan view of one end of a dual time indicating clock embodying the invention.
Figure 3:
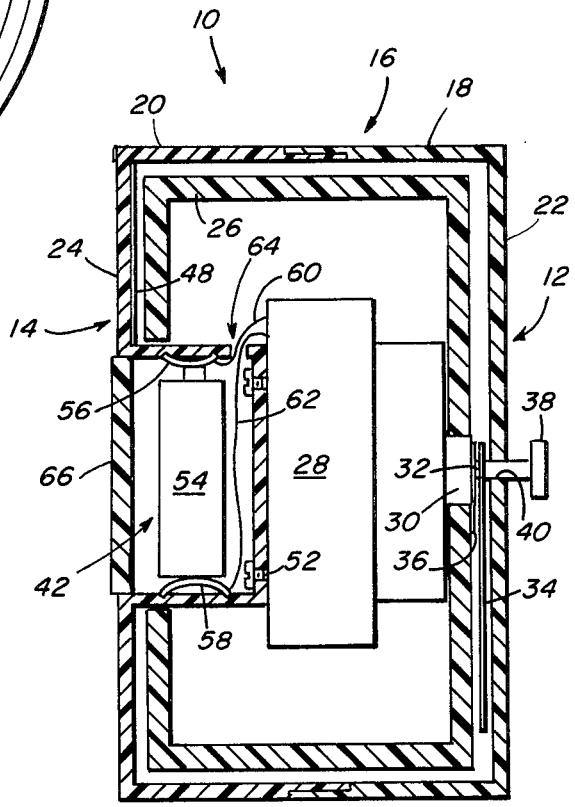
FIG. 3 is a cross section taken along the lines 3—3 in FIG. 2.
Figure 2:
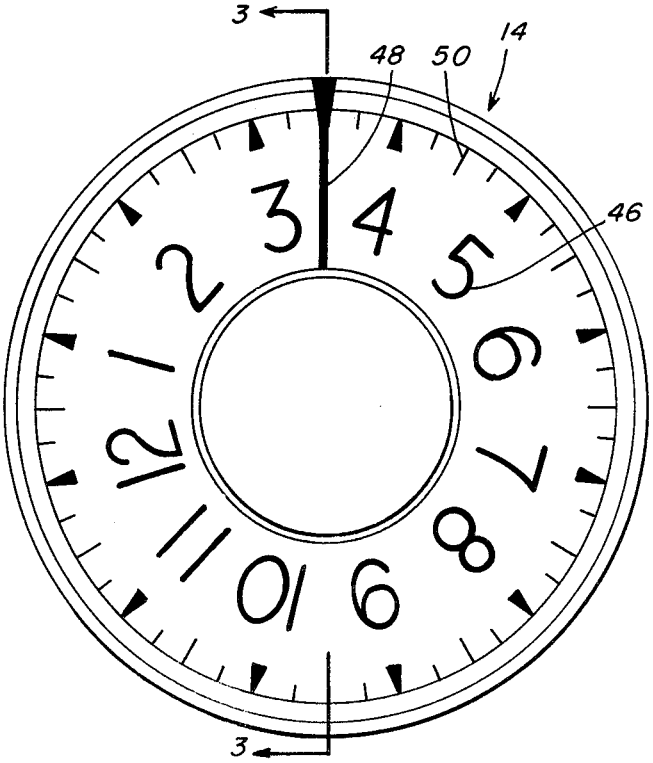
FIG. 2 is a plan view of the other end of the clock of FIG. 1.

Referring now to the drawings, there is shown a clock 10 with dual time indicators 12 and 14 at opposite ends of a clock casing 16. In the illustrated embodiment, by way of example, clock casing 16 is a split casing having casing members 18 and 20 which are composed of a polymer such as methyl methacrylate. Casing member 18 has a transparent end face 22 and casing member 20 has a transparent end face 24. A rotatable drum 26 is mounted within casing 16 and is driven by a motor 28 at a rate of one revolution per each twelve hour period or multiple thereof.

Motor 28 includes a pair of concentric shafts 30 and 32. Shaft 30 rotates at a rate of one revolution per each twelve hour period and shaft 32 rotates at a rate of one revolution per hour. One end of drum 26 is secured to shaft 30 and a minute hand 34 is mounted to shaft 32. Drum 26 is composed of a light weight material, for example a polyurethane foam, which is sufficiently rigid so that the drum is coaxial with shaft 30 when supported only at one end. From the foregoing, it will be readily appreciated that drum 26 rotates at a rate of one revolution per each twelve hour period and minute hand 34 rotates at a rate of one revolution per hour. An hour hand 36 is marked, for example painted or decaled, on the face of drum 26 which is adjacent transparent face 22. Minute hand 34 and hour hand 36 extend radially and outwardly from shafts 32 and 30, respectively, the hour hand being approximately seventy-five percent of the length of the minute hand. A knob 38, which is mounted to shaft 32 and extends through an opening 40 in transparent face 22, is provided for setting the desired time indication.

Transparent face 22 and transparent face 24 are axially disposed about concentric shafts 30 and 32. Casing member 20 is provided with an inwardly extending chamber 42 that is disposed about the center of transparent face 24. Transparent face 22 is located at the end of casing member 18 and transparent face 24 is situated at the end of casing member 20, transparent faces 22 and 24 being positioned at opposite ends of clock casing 16. Transparent face 22 is provided with selected hourly time markings 44, for example Roman numerals, which are circumferentially disposed about the periphery thereof. The end of drum 26 adjacent face 24 is provided with selected hourly time markings 46, for example Arabic numerals, which are disposed circumferentially about the periphery thereof. A reference mark or line 48 on transparent face 24 extends radially between the edge of chamber 42 and the periphery of transparent face 24. A plurality of division lines 50 disposed between hourly time markings 44 and 46 divide the space between adjacent numerals into fractions of an hour. Time is displayed at transparent face 22 by the positions of minute hand 34 and hour hand 36 with respect to numerals 44. Time is displayed at transparent face 24 by the position of numerals 46 with respect to line 48.

In the illustrated embodiment, casing members 18 and 20 are fixed against relative rotation and time indicators 12 and 14 display the same time. In an alternative embodiment, casing members 18 and 20 are relatively rotatable and each one of time indicators 12 and 14 displays the time of a different time zone. When time indicators 12 and 14 display the same time, corresponding numerals on drum 26 and transparent face 22 are in registration. When time indicators 12 and 14 display different times, corresponding numerals on drum 26 and transparent face 22 are displaced from one another.

Motor 28, for example a 1.5 volts DC motor, is mounted within drum 26 and secured to the inner face of chamber 42 by means of fasteners 52, for example screws. A battery 54, which is mounted within chamber 42, is captively held therein by a pair of spring contacts 56, 58. Leads 60 and 62 from motor 28 are connected to contacts 56 and 58 through an opening 64 in the side of chamber 42. A cap 66 is provided to close chamber 42.

In operation of the illustrated embodiment of clock 10, knob 38 is rotated until hour hand 36 and minute hand 34 point to the correct time and line 48 is in registration with a corresponding time indication. It is to be noted that drum 26, which represents hourly movement, rotates one twelfth of a revolution for each revolution of knob 38. As time passes, drum 26 rotates in a clockwise direction when looking at time indicator 12 and rotates in a counter-clockwise direction when observing time indicator 14. In the alternative embodiment when time indicators 12 and 14 indicate times of different time zones, casing member 18 is rotated until a preset time differential is set on time indicators 12 and 14. As time passes, the indicated time differential between time indicators 12 and 14 remains constant. From the foregoing, it will be readily apparent that the present invention discloses a single clock mechanism which operates time indicators on a dual faced clock, the faces being aligned axially at opposite ends of the clock case.

Since certain changes may be made in the foregoing disclosure without departing from the scope of the invention herein involved, it is intended that all matter depicted in the accompanying drawings and described in the foregoing disclosure be construed in an illustrative and not in a limiting sense. For example, in an alternate embodiment, clock 10 is a twenty-four hour clock and time markings 44 and 46 indicate hours one to twenty-four.

What I claim is:

1. A clock with dual time-indicators, said clock comprising:
   (a) a casing;
   (b) a drum rotatably mounted within said casing;
   (c) a motor mounted to said casing, said motor having first and second shafts, said first shaft rotating at a rate of one revolution per a multiple of a twelve hour period and said second shaft rotating at a rate of one revolution per hour, said drum mounted coaxially to and rotating with said first shaft;
   (d) first time-indicating means at one end of said casing; and
   (e) second time-indicating means at an opposite end of said casing.

2. The clock as claimed in claim 1 wherein one end of said drum is provided with time-markings and the other end of said drum is marked with an hour hand and wherein said ends of said casing are transparent, said one end of said casing has a reference mark and said opposite end of said casing adjacent said other end of said drum has time-markings.

3. The clock as claimed in claim 1 wherein said first time-indicating means includes first time-markings on one end of said drum and a line marked on said one end of said casing adjacent said one end of said drum, said first time-markings including selected hourly indicators.

4. The clock as claimed in claim 3 wherein said second time-indicating means includes second time-markings on said opposite end of said casing, an hour hand marked on an end of said drum adjacent said opposite end of said casing and a minute hand mounted to said second shaft, said minute hand disposed between said hour hand and said second time-markings, said second time-markings including selected hourly indicators.

5. The clock as claimed in claim 4 wherein said casing is a split casing having a pair of mating members.

6. The clock as claimed in claim 5 wherein said mating members are fixed against relative rotation and are aligned so that corresponding hourly indicators of said first and second time-markings are in registration.

7. The clock as claimed in claim 5 wherein said mating members are relatively movable with respect to one another and are aligned so that corresponding hourly indicators of said first and second time-markings are displaced from one another.

8. The clock as claimed in claim 4 wherein said motor is a DC motor and said first shaft and said drum rotate at a rate of one revolution per each twelve hour period.

9. The clock as claimed in claim 8 wherein said casing is formed with an inwardly extending chamber that is configured to receive a battery for energizing said motor.

10. The clock as claimed in claim 9 including adjusting means connected to said second shaft for rotating said drum and simultaneously adjusting the dual times displayed by the clock.

* * * * *